US009163399B1

(12) United States Patent
Kelley

(10) Patent No.: US 9,163,399 B1
(45) Date of Patent: Oct. 20, 2015

(54) STOREFRONT CLADDING SYSTEM

(71) Applicant: Brandon Kelley, Carpinteria, CA (US)

(72) Inventor: Brandon Kelley, Carpinteria, CA (US)

( * ) Notice: Subject to any disclaimer, the term of this patent is extended or adjusted under 35 U.S.C. 154(b) by 0 days.

(21) Appl. No.: 14/255,794

(22) Filed: Apr. 17, 2014

(51) Int. Cl.
*E04H 1/00* (2006.01)
*E04B 2/90* (2006.01)
*E06B 3/54* (2006.01)

(52) U.S. Cl.
CPC .. *E04B 2/90* (2013.01); *E06B 3/549* (2013.01)

(58) Field of Classification Search
CPC ..... E04B 2/90; E06B 3/549; E06B 1/34; E06B 1/345; E06B 1/347; E06B 1/38; F16B 2/06
USPC ..... 52/235, 238.1, 211, 212, 204.591, 52/204.593, 772
See application file for complete search history.

(56) References Cited

U.S. PATENT DOCUMENTS

| | | | | |
|---|---|---|---|---|
| 3,023,859 | A | 6/1957 | Muessal | |
| 3,418,772 | A | 12/1968 | Helgesen | |
| 3,943,610 | A | 3/1976 | Meyer | |
| 4,307,551 | A * | 12/1981 | Crandell | 52/235 |
| 4,506,484 | A * | 3/1985 | Bartlett et al. | 52/476 |
| 4,823,533 | A | 4/1989 | Hillstrom | |
| 4,841,700 | A | 6/1989 | Matthews | |
| 5,426,897 | A | 6/1995 | Gazaway | |
| 5,481,839 | A * | 1/1996 | Lang et al. | 52/235 |
| 5,546,713 | A * | 8/1996 | Voegele et al. | 52/202 |
| 5,553,422 | A | 9/1996 | Gazaway | |
| 6,226,947 | B1 * | 5/2001 | Bado et al. | 52/483.1 |
| 6,385,939 | B1 | 5/2002 | Stout | |
| 6,438,913 | B1 * | 8/2002 | Ishikawa et al. | 52/235 |
| 6,745,527 | B1 * | 6/2004 | Sherman et al. | 52/235 |
| 8,347,569 | B1 * | 1/2013 | McIntyre et al. | 52/235 |
| 8,355,482 | B2 | 1/2013 | Brown | |
| 2007/0022682 | A1 * | 2/2007 | Morgenegg et al. | 52/235 |
| 2008/0245001 | A1 | 10/2008 | Alkoury | |
| 2009/0277111 | A1 | 11/2009 | Albrecht | |
| 2011/0138727 | A1 * | 6/2011 | Labrecque | 52/483.1 |
| 2012/0085042 | A1 * | 4/2012 | Macdonald et al. | 52/173.3 |

FOREIGN PATENT DOCUMENTS

| | | | |
|---|---|---|---|
| AU | 698658 | B2 * | 5/1998 |
| AU | 698658 | | 11/1998 |
| EP | 2339090 | A2 | 6/2011 |
| GB | 2072235 | A | 3/1981 |
| WO | WO 02/084038 | | 10/2002 |
| WO | WO2006/095201 | A1 | 9/2006 |

* cited by examiner

*Primary Examiner* — Mark Wendell
(74) *Attorney, Agent, or Firm* — Cislo & Thomas, LLP

(57) ABSTRACT

A retrofit cladding system that allows a home, office, or building to replace its cladding without having to remove the foundational frames utilizing at least one frame clip that can attach to the foundational frame structure of the home, office, building, and a plurality of cladding members that can attach to the foundational frame or the frame clip to cover the foundational frame and provide support for a window.

9 Claims, 8 Drawing Sheets

STOREFRONT CLADDING SYSTEM

TECHNICAL FIELD

This invention relates to a method and system for changing claddings on a building without having to remove the foundational frames.

BACKGROUND

A building may have an ornate storefront where large glass windows are held in by aluminum frames to attract potential customers to walk in. For example, most modern malls, convenience stores, and supermarkets have aluminum storefronts with large windows. Although aluminum is durable and corrosion resistant, eventually a storefront will look worn and dated. To update such storefronts, usually the entire storefront must be replaced, including the aluminum frames. This requires demolition of the old storefront and starting the installation from scratch, even though the existing storefront framing is still structurally sound.

Therefore, what is needed is a lower-cost method of updating a storefront without complete removal of the framing and/or glass.

SUMMARY

The present invention is directed to a cladding system that can be installed on storefront framing systems so that the frames have a new look without having to remove the existing frames or replace the glass. Frame clips may be used to allow the cladding system to be quickly and easily installed on the frames. Thus, rather than removing foundational frames, only the non-foundational components of the frame need be removed, leaving the foundational frames intact. Frame clips, as necessary, can be installed on the foundational frames, and the new claddings can be installed on the foundational frame either by clipping the claddings onto frame clips and/or directly onto the frames themselves. Therefore, the invention of the present application minimizes the number of components required for installing new claddings, and makes the installation easier with the frame clips without compromising the integrity of the attachment.

DETAILED DESCRIPTION OF THE INVENTION

Figure 1:
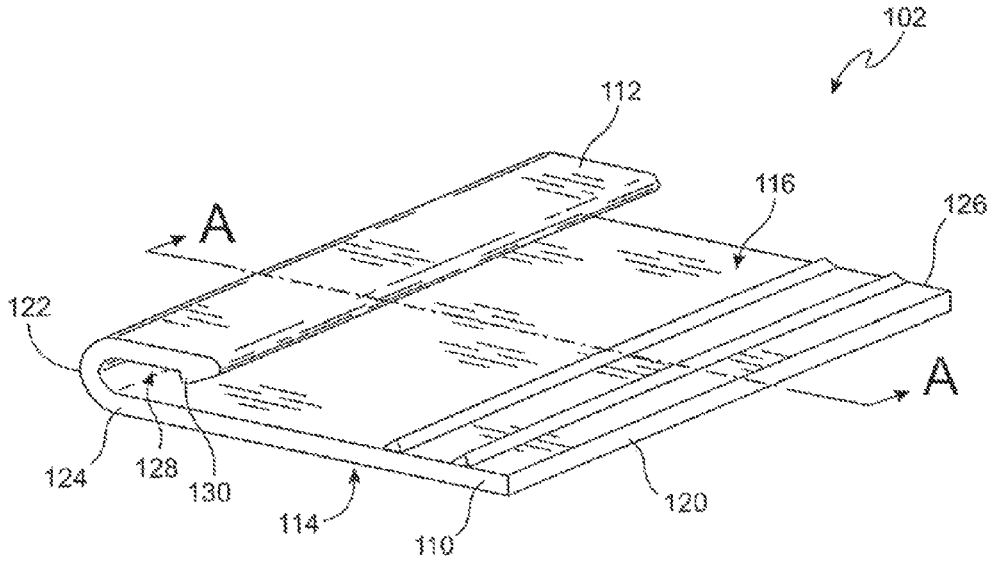
FIG. 1 shows a perspective view of an embodiment of a frame clip.

The detailed description set forth below in connection with the appended drawings is intended as a description of presently-preferred embodiments of the invention and is not intended to represent the only forms in which the present invention may be constructed or utilized. The description sets forth the functions and the sequence of steps for constructing and operating the invention in connection with the illustrated embodiments. It is to be understood, however, that the same or equivalent functions and sequences may be accomplished by different embodiments that are also intended to be encompassed within the spirit and scope of the invention.

The present invention is directed towards a retrofit cladding system that allows a home, office, building, and the like to replace its cladding without having to remove the foundational frames. For example, a building may have an ornate storefront including one or more display windows to attract potential customers to walk in. The storefront can fade or become damaged, or the owner may wish to update or upgrade the storefront. The display windows are held up by frames. In order to update a storefront, the entire storefront, including the frames, must be replaced. With the invention of the present application, however, the frames can remain intact, and only the claddings and possibly the display window would need changing.

As shown in FIGS. 3-8, the retrofit cladding system 100 comprises at least one frame clip 102*a* attachable to the frame 10, and at least one cladding member 104*a* attachable to the frame clip 102*a* and/or the frame 10 itself. The cross-sectional views of FIGS. 3-8 are generally taken through lines B-B shown in FIG. 2, but when properly installed for each respective embodiment. The number of frame clips 102*a-d* and cladding members 104*a, b* required depends on the frame 10 structure. The frame clips 102*a-d* and the cladding members 104*a, b* are configured so that the frame clips 102*a-d* can be attached to the frame 10 by any fastening means 12, such as screws, nails, adhesives, hook and loop fasteners, magnets, and the like, and any combination thereof. In the preferred embodiment, a cladding member 104 is configured to simply slide into a frame clip 102 and snap together.

As shown in FIG. 1, in general, a frame clip 102 comprises a base member 110 and a hook member 112. The base member 110 may be a thin flat piece of material that is placed flat against the frame 10 and secured to the frame 10 by any type of fastener 12. In the preferred embodiment, the base member 110 may be screwed into the frame 10. Preferably, the base member 110 is rectangular in shape having a first side 114 that can be placed flat against the frame, and a second side 116 opposite the first side 114 facing away from the frame, the first and second sides 114, 116 being bound by a first end 120, a second end 122 opposite and parallel to the first end 120, a third end 124 perpendicular to the first and second ends 120, 122, and a fourth end 126 opposite and parallel to the third end 124 and perpendicular to the first and second ends 120, 122. Although the preferred embodiment has been described generally as a rectangle, other shapes can be used for the frame clip 102.

In the preferred embodiment, the hook member 112 emerges from one of the ends (e.g. end 122) and curves or bends towards the second side 116, then towards the opposite end (e.g. end 120) to create a hairpin turn. The free end 128 may comprise a lip 130 projecting transversely from the hook member 112. This lip 130 can provide a catch onto which the cladding member 104 may be secured. In some embodiments, the free end 128 may taper as it moves away from the lip 130 and towards its terminus. This taper facilitates the connection with the cladding member 104 as discussed below.

In some embodiments, multiple frame clips 102*a-d* may be used to secure a single cladding member 104 or multiple cladding members 104*a*, 104*b*. Therefore, a second frame clip 102*b* comprising a second base member 110*b* and a second hook member 112*b* may be attached to the frame 10 in strategic locations to create additional attachment points for the cladding member 104 or members 104*a*, 104*b*.

Figure 2:
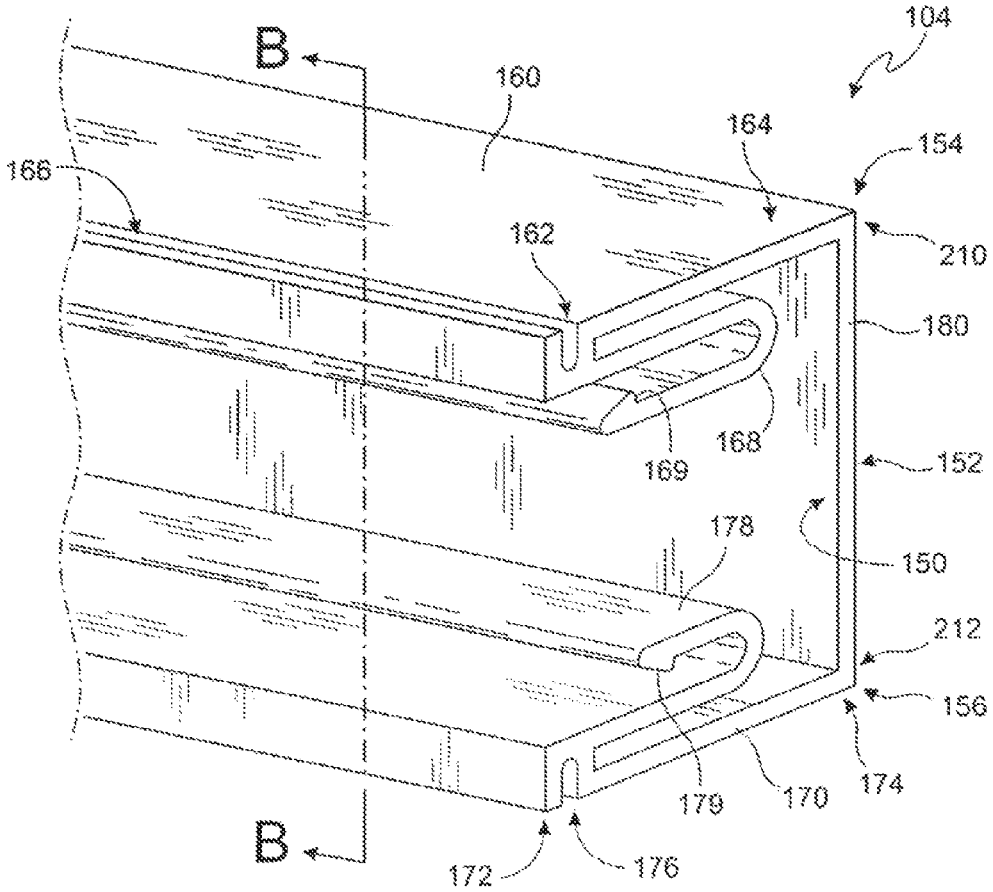
FIG. 2 shows a partial perspective view of an embodiment of a cladding member.
Figure 3:
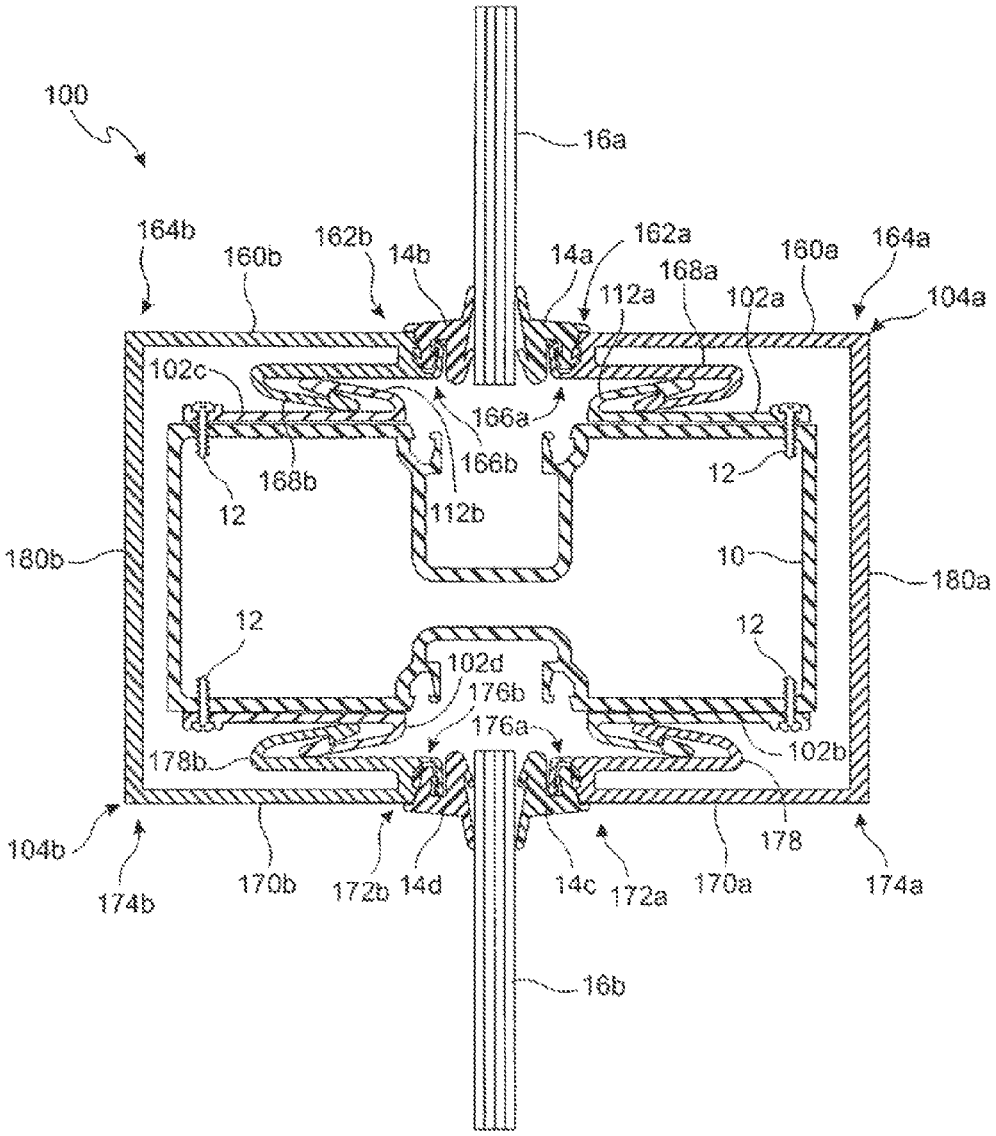
FIG. 3 shows a cross-section of an embodiment of the cladding members installed on a foundational frame.

The cladding member 104 is configured to cover or substantially cover the frame 10. It may also provide support for a window. In the preferred embodiment, multiple cladding members 104*a*, 104*b* may work together to cover or substantially cover the frame 10 as shown in FIGS. 3-8. As shown in FIG. 2, in general, a cladding member 104 is generally an elongated member having an inner side 150 and an outer side 152, and one or more bends 154, 156 to wrap (at least partially) around frame 10. The inner side 150 of the cladding member 104 is configured to attach to one or more frame clips 102 and/or attach directly to the frame 10, while the outer side 152 presents an aesthetic appearance and/or a protective covering. For example, the inner side 150 may comprise one or more reciprocal clips 168, 178 configured to attach to a frame clip 102. In some embodiments, the inner side may also comprise one or more posts 220 projecting perpendicularly from any arm 160, 170, 180 configured to be abuttable (or capable of abutting) against the frame 10 when properly installed.

In some embodiments, the cladding member 104 has a first arm 160 having a first end 162 and a second end 164 opposite the first end 162, a second arm 170 opposite and parallel to the first arm 160, the second arm 170 having a third end 172 and a fourth end 174 opposite the third end 172, and a first adjoining arm 180 operatively connecting the first arm 160 with the second arm 170, preferably, through the second and fourth ends 164, 174, respectively. In the preferred embodiment, the adjoining arm 180 may be perpendicular to the first and second arms 160, 170. Therefore, this embodiment has a generally U-shaped appearance. However, other arrangements may be used for different appearances or functions.

The connection between the adjoining arm 180 and the first and second arms 160, 170 may result from separate pieces being attached together or a single piece of material integrally formed and bent at the bends 154, 156. Therefore, the terms "connect" or "operatively connect," and variations thereof, do not necessarily mean separate, multiple pieces being attached together. Rather, it more broadly designates a transition point to be able to refer to different components, parts, or features in a convenient manner.

Figure 8:
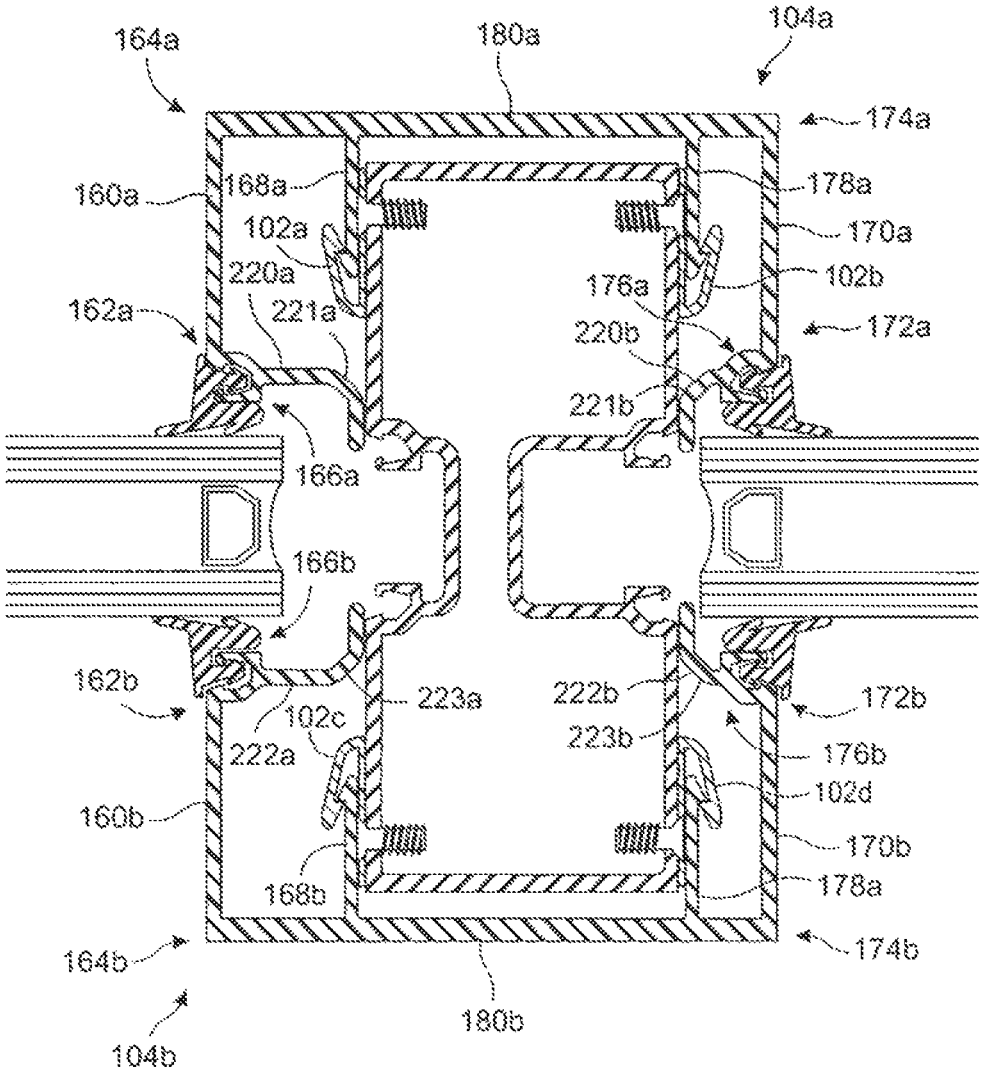
FIG. 8 shows a cross-section of another embodiment of the cladding members installed on a foundational frame.

The first arm 160 comprises a first channel 166 formed at the first end 162, and a first reciprocal clip 168 stemming from the first arm 160. In some embodiments, as shown in FIG. 8, the first reciprocal clip 168*a* may stem from the adjoining arm, but be adjacent to the first arm 160*a*. The first reciprocal clip 168 may be used to attach the cladding member 104 to a first frame clip 102*a* and/or the frame 10 itself. The second arm 170 comprises a second channel 176 formed at the third end 172, and a second reciprocal clip 178 stemming from the second arm 170 that is attachable to a second frame clip 102*b* and/or the frame 10 itself. In some embodiments, as shown in FIG. 8, the second reciprocal clip 178*a* may project from the adjoining arm 180, but be adjacent to the second arm 170*a*. In some embodiments, the reciprocal clips 168, 178 look much like a frame clip 102, but facing in an opposite orientation relative to the frame clip 102. In some embodiments, the reciprocal clips 168, 178 may be straight members with a lip 169, 179 at a free end. The idea is to allow the reciprocal clip 168 or 178 to slide into the frame clip 102 and have their respective lips 169 or 179, and 130 engage one another.

In some embodiments, this may be sufficient to cover one side of the frame 10. In such a case, a second cladding member 104*b* may be used to cover the opposite side of the frame 10 as shown in FIGS. 3-8. The second cladding member 104*b* may comprise a third arm 160*b* having a fifth end 162*b* and a sixth end 164*b* opposite the fifth end 162*b*, a fourth arm 170*b* opposite and parallel to the third arm 160*b*, the fourth arm 170*b* having a seventh end 172*b* and an eighth end 174*b* opposite the seventh end 172*b*, and a second adjoining arm 180*b* operatively connecting the third arm 160*b* with the fourth arm 170*b* through the sixth and eighth ends 164*b*, 174*b*, respectively. The second adjoining arm 180*b* may be perpendicular to the third and fourth arms 160*b*, 170*b*. The third arm 160*b* may comprise a third channel 166*b* formed at the fifth end 162*b*, and a third reciprocal clip 168*b* stemming from the third arm 160*b* and attachable to a third frame clip 102*c* and/or the frame 10 itself. In some embodiments, the third reciprocal clip 168*b* may stem from the adjoining arm 180*b*, but be adjacent to the third arm 160*b*, as shown in FIG. 8.

The fourth arm 170*b* may comprise a fourth channel 176*b* formed at the seventh end 172*b*, and a fourth reciprocal clip 178*b* stemming from the fourth arm 170*b*. In some embodiments, the fourth reciprocal clip 178*b* may stem from the adjoining arm 180*b*, but be adjacent to the fourth arm 170*b*, as shown in FIG. 8. The fourth reciprocal clip 178*b* can be attached to a fourth frame clip 102*d* and/or the frame 10 itself. Once both cladding members 104*a*, 104*b* have been properly attached to the frame 10, the first and second cladding members 104*a*, 104*b* cover at least substantially all of the frame 10.

Once the first and second cladding members 104*a*, 104*b* are properly installed, the first and third channels 166*a*, 166*b* may be adjacent to each other, but separated by a gap. Similarly, the second and fourth channels 176*a*, 176*b* may be adjacent to each other, but separated by a gap. The channels are configured to receive and hold individual gaskets 14*a-d* so that a window 16*a* or 16*b* can be placed into the gap, in between the gaskets 14*a-d*. The gaskets 14*a-d* create a water and wind-tight seal against the window 16*a* or 16*b*, and the cladding members 104*a*, 104*b* create a support structure for the windows 16*a*, 16*b*. Once the cladding system 100 is completely assembled with the gaskets 14*a-d* and windows 16*a, b*, the frame 10 may be completely covered and hidden from the customers. This particular type of configuration is designed for non-end unit frames or frames in which windows 16*a*, 16*b* are needed on opposite sides, as shown in FIGS. 3, 4, 7, and 8.

Figure 4:
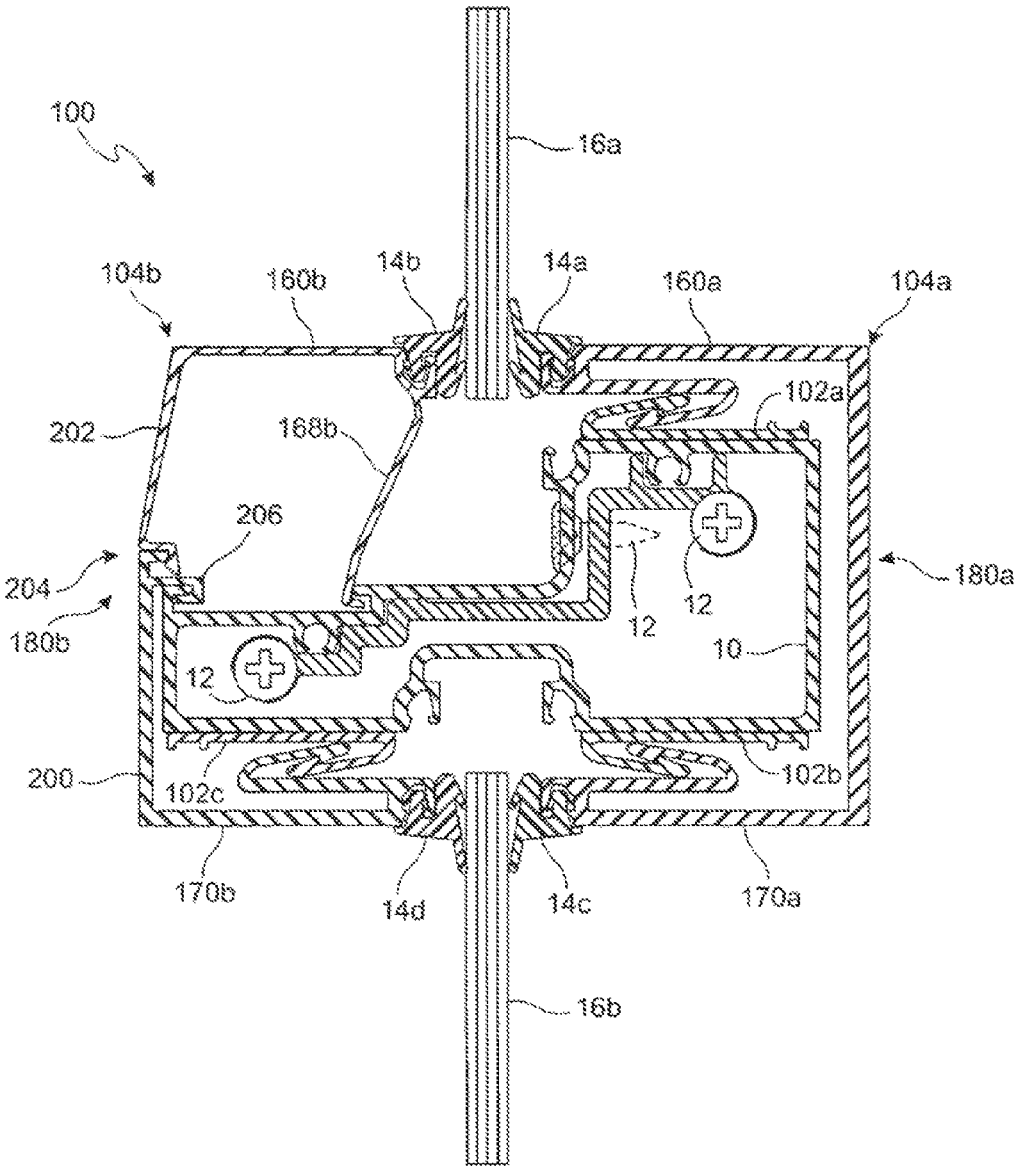
FIG. 4 shows a cross-section of another embodiment of the cladding members installed on a foundational frame.
Figure 7:
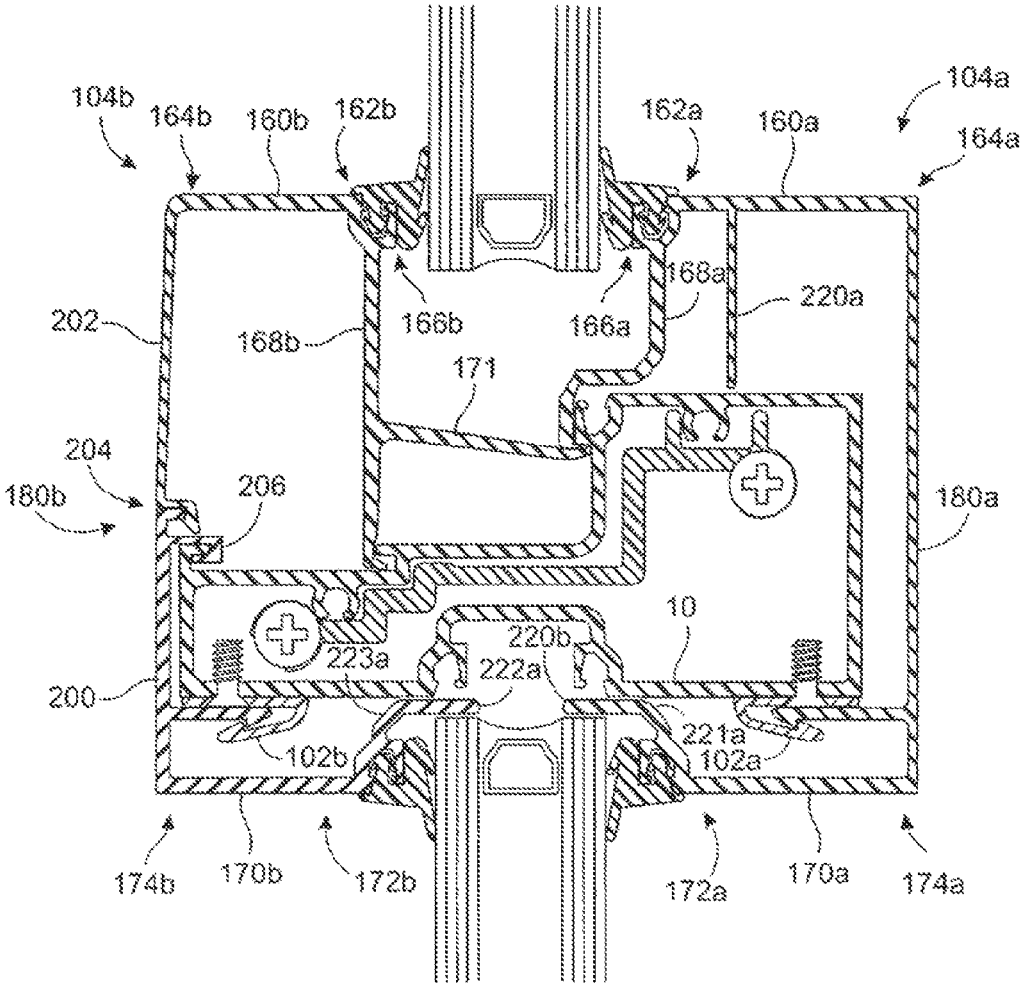
FIG. 7 shows a cross-section of another embodiment of the cladding members installed on a foundational frame.

Different variations of this concept can be used depending on the configuration of the frame 10. For example, in some embodiments, as shown in FIGS. 4 and 7, there may not be a convenient location to place one of the frame clips 102*a-d* to properly secure or stabilize all of the arms of the cladding members. In such an embodiment, one or more of the reciprocal clips (168*b* for example) may have to be configured to attach directly to the frame 10. In some embodiments, for example with thick, insulated, or double pane windows, an auxiliary clip 171 may be used to further stabilize the connection. As shown in the example in FIG. 7, the auxiliary clip 171 may stem from the reciprocal clip (168*b* for example) as a crossbar to connect to the frame on the opposite side. In some embodiments, as shown in FIGS. 4 and 7, one or more of the cladding members (104*b* for example) may be a two piece member having a first member 200 and a second member 202 that are attached to each other at the adjoining arm 180*b* by a fastening mechanism 204. Preferably, this type of attachment is via a snap-fit connection, although any type of fastening mechanism can be used. For added stability, the adjoining arm 180*b* may have a fifth reciprocal clip 206 attachable to the frame 10. In some embodiments, any of the arms 160*a*, 170*a*, 180*a*, 160*b*, 170*b*, 180*b* can have a post

Figure 5:
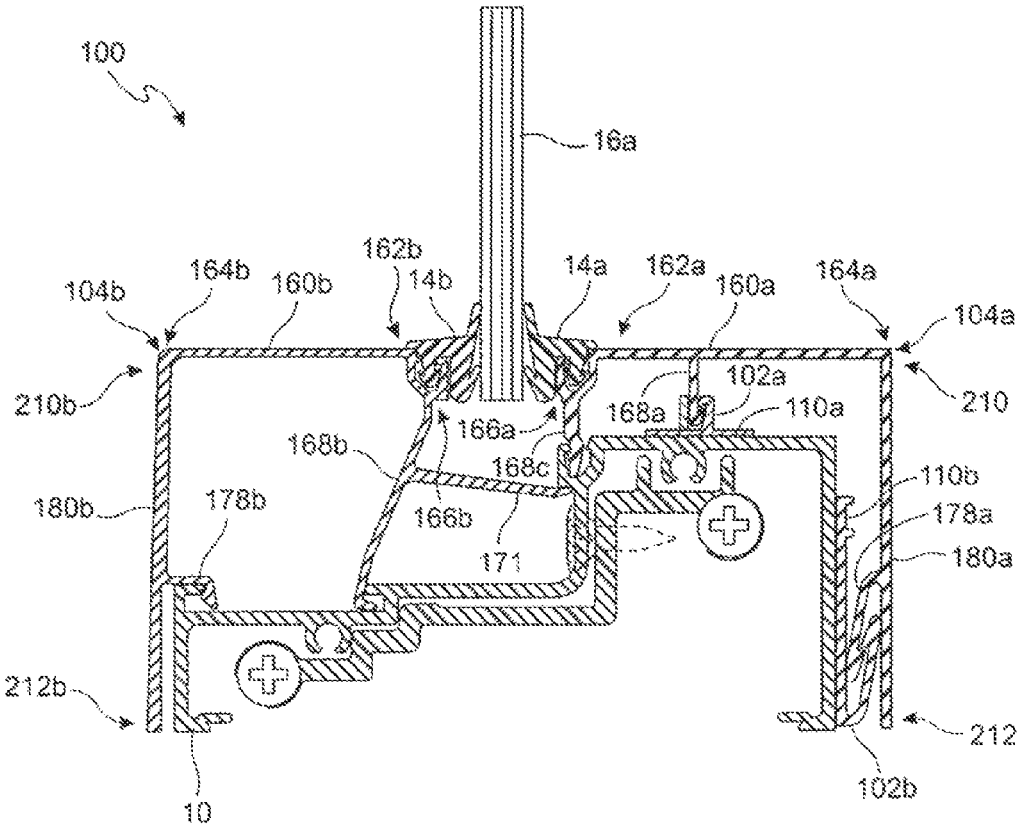
FIG. 5 shows a cross-section of another embodiment of the cladding members installed on a foundational frame.

220*a*, 220*b*, 222*a*, 222*b* projecting therefrom to be abuttable against the foundational frame 10 for added support as shown in FIG. 8, as necessary or desired. In some embodiments, any of the posts 220*a*, 220*b*, 222*a*, 222*b* can also function as a reciprocal clip 168*a* as shown in FIG. 5. In some embodiments, where the posts 220*a*, 220*b*, 222*a*, 222*b* approaches the foundational frame when properly installed, the posts 220*a*, 220*b*, 222*a*, 222*b* may have a medial bend 221*a, b*, 223*a, b* causing the free ends of the posts 220*a*, 220*b*, 222*a*, 222*b* to bend medially in the direction of the gap as shown in FIGS. 7 and 8. This could provide a wall to prevent the window from be inserted too deeply. In some embodiments, the posts 220*a*, 220*b*, 222*a*, 222*b* may stem from directly beneath their respective channel 166*a*, 176*a*, 166*b*, 176*b*, on the opposite side of the channel to provide added support at the channel as shown in FIGS. 5 and 8. In some embodiments, any of the posts 220*a*, 220*b*, 222*a*, 222*b* may also function as a reciprocal clip attachable to the frame 10 as shown in FIGS. 5 and 7.

Figure 6:
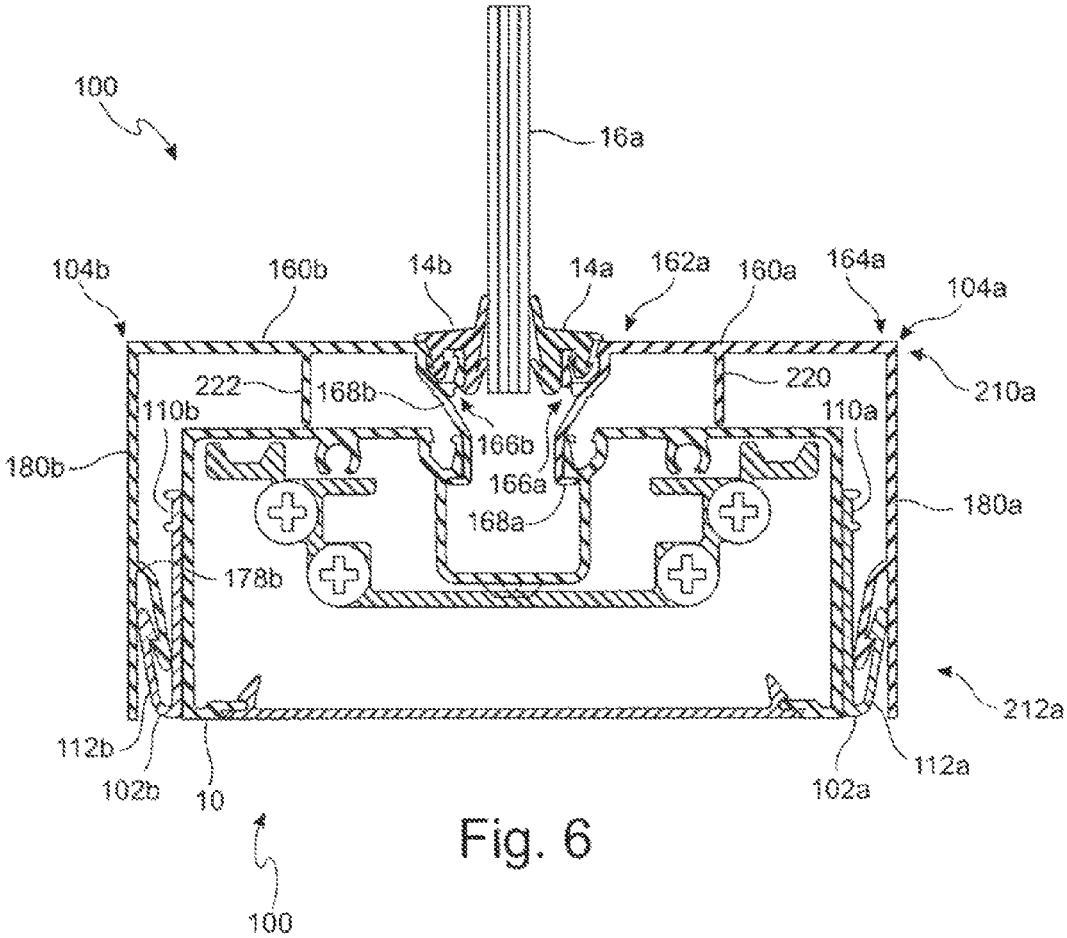
FIG. 6 shows a cross-section of another embodiment of the cladding members installed on a foundational frame.

The cladding system 100 can be modified to apply to end-unit frames in which a window 16*a* is needed on only one side, as shown in FIGS. 5 and 6. In such an embodiment, the retrofit cladding system 100 may comprise one or more frame clips 102*a*, 102*b*, each frame clip having a base member 110*a*, 110*b* and a hook member 112*a*, 112*b*. The first cladding member 104*a* may comprise a first arm 160*a* having a first end 162*a* and a second end 164*a* opposite the first end 162*a*, and a first adjoining arm 180*a* having a third end 210*a* and a fourth end 212*a* opposite the third end 210*a*, the first adjoining arm 180*a* operatively connected to the first arm 160*a* at the second and third ends 164*a*, 210*a*. Preferably, the first adjoining arm 180*a* is perpendicular to the first arm 160*a*. The first arm 160*a* may comprise a first channel 166*a* formed at the first end 162*a*, and a first reciprocal clip 168*a* adjacent to the first arm 160*a*, and attachable to a frame clip 102*a* and/or the frame 10 itself. The first adjoining arm 180*a* may comprise a second reciprocal clip 178*a* attachable to another frame clip 102*b* or the frame 10 itself.

Similarly, a second cladding member 104*b* may be attached to the frame 10 opposite the first cladding member 104*a*. The second cladding member 104*b* may comprise a second arm 160*b* having a fifth end 162*b* and a sixth end 164*b* opposite the fifth end 162*b*, and a second adjoining arm 180*b* having a seventh end 210*b* and an eighth end 212*b* opposite the seventh end 210*b*, the second adjoining arm 180*b* operatively connected to the second arm 160*b* at the sixth and seventh ends 164*b*, 210*b*. Preferably, the second adjoining arm 180*b* is perpendicular to the second arm 160*b*. The second arm 160*b* comprises a second channel 166*b* formed at the fifth end 162*b*, and a third reciprocal clip 168*b* attachable to a frame clip 102 and/or the frame 10 itself. The second adjoining arm 180*b* may comprise a fourth reciprocal clip 178*b* attachable to a frame clip 102*b* and/or the frame 10 itself. Once the first and second cladding members 104*a*, 104*b* are properly installed, the frame 10 is at least substantially covered with a gap formed between the two channels 166*a*, 166. The channels 166*a*, 166*b* are configured to receive gaskets 14*a*, 114*b*, in between which, a window 16*a* can be installed as discussed above, Like the previous embodiments, the end-unit embodiment can have a number of variations. For example, the reciprocal clips 168*a*, 168*b*, 178*a*, 178*b* can project from any of the arms 160*a*, 160*b*, 180*a*, 180*b*. In some embodiments, any of the arms 160*a*, 160*b*, 180*a*, 180*b* may have a post 220, 222 projecting perpendicularly from the arm and capable of abutting against the frame 10 when properly installed. For example, in FIG. 6, the first arm 160*a* has a post 220 extending perpendicularly therefrom and abuttable against the foundational frame 10. Thus, when pressure is applied perpendicularly to the first arm 160, the first post 220 helps to support or resist the pressure. Similarly, the second arm 160*b* of the second cladding member 104*b* may comprise a second post 222 projecting perpendicularly from the second arm 160*b* and capable of abutting against the frame 10 when properly installed. Any other arm can have a post as necessary or desired. In some embodiments, such as that shown in FIG. 5, the reciprocal clips 168*a*, 168*b* can function as fasteners and posts due to their transverse or perpendicular arrangement relative to their respective arms 160*a*, 160*b*. In some embodiments, the reciprocal clips 168*b, c* may extend from the bottom of the channel 166*a*, 166*b* to provide support at the channels 166*a*, 166*b* as well as serving as a fastener to the frame 10 directly or through frame clips.

In use, an existing storefront framing system can be retrofitted with new cladding by removing the non-foundational components of the storefront framing to expose a foundational frame 10, fastening a first frame clip 102*a* to the foundational frame 10, fastening a first retrofit cladding member 104*a* to the foundational frame 10 via the first frame clip 102*a* to substantially cover one side of the foundational frame 10, fastening a second retrofit cladding member 104*b* to the foundational frame 10 to substantially cover an opposite side of the foundational frame 10. Due to the parallel configuration of the frame clips 102 and the arms of the cladding members 104 when properly positioned, the cladding member 104 is able to slide onto the frame clips 102 very quickly and easily. When the gaskets 14*a-d* and the windows 16*a*, 16*b* are installed, a force is created on the cladding members 104 to lock the cladding member 104 to its frame clip 102.

When the first retrofit cladding member 104 and the second retrofit cladding member 104*b* are properly installed, the foundational frame 10 is at least substantially covered by the first and second retrofit claddings members 104*a*, 104*b*. A small gap may exist between two claddings 104*a*, 104*b*. A pair of gaskets 14*a*, 14*b* can be inserted into respective channels 166*a*, 166*b* defined by the cladding so that the gaskets 14*a*, 14*b* are in between the first and second claddings 104*a*, 104*b*. A window 16*a* can be inserted in between the gaskets 14*a*, 14*b*. This system minimizes that number of components required and the quick snap fits make it is easy to install a new cladding to an existing storefront, while providing surprisingly secure attachments.

The order of events can be modified in any logical order. For example, the first cladding 104*a* may be installed, then the first gasket inserted 14*a*. The window 16*a* may be position against the first gasket 14*a*. The second cladding 104*b* can then be installed and the second gasket 14*b* inserted in between the second cladding 104*b* and the window 10.

In some embodiments, a plurality of frame clips 104*a-d* may be installed on the frame so that the reciprocal clips 168*a*, 168*b*, 178*a*, 178*b* can be attached to the frame via the frame clips 104*a-d* instead of directly to the frame 10. Any combination of attachments of reciprocal clips attaching to frame clips or to the frame directly can be used depending on the structure of the frame.

The frame clips 102 and cladding members 104 can be made of any sturdy material, such as metal, plastic, and the like, or any combination thereof using known methods in the art.

The foregoing description of the preferred embodiment of the invention has been presented for the purposes of illustration and description. Features of the different embodiments shown are not necessarily mutually exclusive. As such, features shown in one embodiment can be applied to other embodiments. Therefore, it is not intended to be exhaustive or to limit the invention to the precise form disclosed. For example, reference to ordinal numbers (such as first, second, third, etc.) does not limit the structure to the specific embodiment shown or referenced, but rather, are relative based on the number of similar structures previously recited for ease of description only. Many modifications and variations are possible in light of the above teaching. It is intended that the scope of the invention not be limited by this detailed description, but by the claims and the equivalents to the claims appended hereto.

What is claimed is:

1. A method for retrofitting an existing storefront framing system with new cladding, comprising:

a. removing non-foundational components of the storefront framing to expose a foundational frame;

b. fastening a frame clip to the foundational frame;

c. fastening a first cladding member to the foundational frame via the frame clip by sliding the first cladding member towards the foundational frame to substantially cover one side of the foundational frame, wherein the first cladding member comprises:

i. a first arm having a first end and a second end opposite the first end, wherein the first arm comprises a first channel formed at the first end, ii. a first adjoining arm having a third end and a fourth end opposite the third end, the first adjoining arm operatively connected to the first arm at the second and third ends opposite the first channel, the first adjoining arm perpendicular to the first arm, and iii. a first reciprocal clip attachable to the frame clip;

d. fastening a second cladding member to the foundational frame by sliding the second cladding member towards the foundational frame to substantially cover an opposite side of the foundational frame, wherein the second cladding member comprises:

i. a second arm having a fifth end and a sixth end opposite the fifth end, wherein the second arm comprises a second channel formed at the fifth end, ii. a second adjoining arm having a seventh end and an eighth end opposite the seventh end, the second adjoining arm operatively connected to the second arm at the sixth and seventh ends opposite the second channel, the second adjoining arm perpendicular to the second arm, and iii. a second reciprocal clip attachable to the foundational frame, e. whereby when the first cladding member and the second cladding member are properly installed, the foundational frame is at least substantially covered by the first and second cladding members.

2. The method of claim 1, further comprising fastening a second frame clip to the foundational frame and fastening the second cladding member to the foundational frame via the second frame clip.

3. The method of claim 1, further comprising fastening a plurality of frame clips to the foundational frame and fastening the first and second cladding members to the foundational frame via the plurality of frame clips.

4. The method of claim 1, further comprising installing a pair of gaskets in between the first and second cladding members, the pair of gaskets defining a gap therebetween.

5. The method of claim 4, further comprising installing a window in between the pair of gaskets, wherein the gaskets create a seal against the window.

6. A method for retrofitting an existing storefront framing system with new cladding, comprising:

a. removing non-foundational components of the storefront framing to expose a foundational frame;

b. fastening a frame clip to the foundational frame;

c. fastening a first cladding member to the foundational frame via the frame clip to substantially cover one side of the foundational frame;

d. fastening a second cladding member to the foundational frame to substantially cover an opposite side of the foundational frame;

e. inserting a window in between the first cladding member and the second cladding member, whereby when the first cladding member and the second cladding member are properly installed, the foundational frame is at least substantially covered by the first and second cladding members.

7. The method of claim 6, wherein the first cladding member comprises:

a. a first arm having a first end and a second end opposite the first end, wherein the first arm comprises a first channel formed at the first end, b. a first adjoining arm having a third end and a fourth end opposite the third end, the first adjoining arm operatively connected to the first arm at the second and third ends, the first adjoining arm perpendicular to the first arm, and c. at least one reciprocal clip attachable to the frame clip.

8. The method of claim 7, wherein the second cladding member comprises:

a. a second arm having a fifth end and a sixth end opposite the fifth end, wherein second arm comprises a second channel formed at the fifth end, and a third reciprocal clip attachable to the foundational frame, and b. a second adjoining arm having a seventh end and an eighth end opposite the seventh end, the second adjoining arm operatively connected to the second arm at the sixth and seventh ends, the second adjoining arm perpendicular to the second arm, and c. at least one reciprocal clip attachable to the foundational frame.

9. The method of claim 7, wherein fastening the second cladding member to the foundational frame comprises:

a. fastening a second frame clip to the foundational frame; and b. fastening the second cladding member to the second frame clip.

* * * * *